US006759375B2

(12) United States Patent
Curtis et al.

(10) Patent No.: US 6,759,375 B2
(45) Date of Patent: Jul. 6, 2004

(54) USE OF AN AMIDE TO REDUCE LUBRICANT TEMPERATURE

(75) Inventors: Thomas T. Curtis, Mentor, OH (US); Ewa A. Bardasz, Mentor, OH (US); Daniel H. Heath, Ravenna, OH (US); Peter B. Thomson, Danville, CA (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/154,203

(22) Filed: May 23, 2002

(65) Prior Publication Data

US 2003/0220209 A1 Nov. 27, 2003

(51) Int. Cl.[7] ..... C10M 133/16
(52) U.S. Cl. ..... 508/551; 508/554
(58) Field of Search ..... 508/551, 554

(56) References Cited

U.S. PATENT DOCUMENTS

| | | | | | |
|---|---|---|---|---|---|
| 4,280,916 | A | * | 7/1981 | Richards et al. | 508/551 |
| 4,743,389 | A | * | 5/1988 | Braid et al. | 508/551 |
| 4,789,493 | A | * | 12/1988 | Horodysky | 508/554 |
| 4,816,171 | A | * | 3/1989 | Horodysky | 508/554 |
| 4,981,602 | A | | 1/1991 | Ripple et al. | 252/32.7 E |
| 5,328,620 | A | | 7/1994 | Ripple | 252/32.7 E |
| 5,356,546 | A | * | 10/1994 | Blystone et al. | 508/478 |
| 5,501,714 | A | * | 3/1996 | Valentine et al. | 44/358 |
| 5,595,964 | A | | 1/1997 | Bardasz | 508/423 |
| 5,652,201 | A | | 7/1997 | Papay et al. | 508/228 |
| 5,743,922 | A | * | 4/1998 | Peter-Hoblyn et al. | 44/301 |
| 6,323,162 | B1 | * | 11/2001 | Yasunori et al. | 508/192 |
| 6,329,328 | B1 | * | 12/2001 | Koganei et al. | 508/365 |

FOREIGN PATENT DOCUMENTS

| | | | | |
|---|---|---|---|---|
| EP | 0814148 | A2 * | 12/1997 | C10M/141/12 |
| EP | 0835924 | A1 * | 4/1998 | C10M/169/04 |
| EP | 1018539 | A2 * | 7/2000 | C10M/159/24 |

OTHER PUBLICATIONS

McKinley, SAE Technical Paper 970636, "Modeling Sulfuric Acid Condensation in Diesel Engine EGR Coolers," Feb. 24–27, 1998, p. 207.

Leet et al., SAE Technical paper 980179, "EGR's Effect on Oil Degradation and Intake System Performance," Feb. 23–26, 1998, pp. 57–59.

* cited by examiner

*Primary Examiner*—Ellen M McAvoy
(74) *Attorney, Agent, or Firm*—David M. Shold; Michael F. Esposito

(57) ABSTRACT

A sump-lubricated internal combustion engine equipped with exhaust gas recycle, lubricated with (a) an oil of lubricating viscosity, (b) 0.05 to 1 percent by weight of an amide of an aliphatic carboxylic acid, and (c) at least one additional dispersant, detergent, or anti-wear agent, exhibits reduced temperature of the lubricant in the sump.

16 Claims, No Drawings

USE OF AN AMIDE TO REDUCE LUBRICANT TEMPERATURE

BACKGROUND OF THE INVENTION

The present invention relates to lubricating an internal combustion diesel engine which is equipped with an exhaust gas recirculation system (exhaust gas recycle) with a lubricant which includes an amide, leading to lower sump temperature of the lubricant.

Various techniques to abate emissions of such materials as nitrogen oxides and particulate matter, from engines, and in particular, heavy duty diesel engines, have been also developed. One of these methods is the installation of exhaust gas recirculation (EGR) systems. An EGR system recycles part of exhaust gases into the intake air stream. EGR has been used for the control of nitrogen oxide emissions for light duty diesel and gasoline engines. However, this approach has not been widely adopted for heavy duty diesel engines because of various problems, such as decreased durability and reliability of the engine and deterioration of the lubricant which have been associated with EGR. These and related difficulties are believed to arise, in part, because of the increased engine and lubricant temperatures encountered in such engines, due to the recycling of a portion of hot exhaust gas.

The present invention, therefore, addresses the problem of excessive lubricant sump temperature in diesel engines with an exhaust gas recirculation system by including within the lubricant an amide of an aliphatic carboxylic acid. This permits reduction of the lubricant temperature, leading to an increase in its useful lifetime, or, alternatively, recycling of a larger fraction of the exhaust gas without an unacceptable increase in the lubricant temperature.

The use of aliphatic amides as a friction modifier component of engine lubricants is generally known and are disclosed, for example, in U.S. Pat. No. 5,652,201 However, the use of aliphatic amides in engines without EGR has been shown to tend to lead at times to valve train wear, and thus such materials are not often used. It has now been observed that, for reasons that are not entirely understood, valve train wear is not such a problem in engines with EGR when aliphatic amide is present. This opens the possibility for use of such amines, as in the present invention, for the reduction of oil temperature, a possibility which is precluded in practice for engines without EGR.

SUMMARY OF THE INVENTION

The present invention provides a method for lubricating a sump-lubricated internal combustion diesel engine equipped with an exhaust gas recirculation system, comprising supplying to said engine a lubricating oil composition comprising:

(a) an oil of lubricating viscosity;

(b) about 0.05 to about 1 percent by weight of an amide of an aliphatic carboxylic acid, said acid containing 6 to 28 carbon atoms; and (c) at least one additional additive selected from the group consisting of dispersants, detergents, anti-wear agents;

whereby the oil-sump temperature or the piston liner temperature is reduced under operating conditions, compared to that of a comparable composition without component (b).

DETAILED DESCRIPTION OF THE INVENTION

Various preferred features and embodiments will be described below by way of non-limiting illustration.

The present invention is particularly suitable for use in a diesel engine with exhaust gas recycle, such as a passenger car diesel engine or, especially, a heavy duty diesel engine with exhaust gas recycle. The construction of such engines and such exhaust gas recycle systems is well known and is described in detail, for example, in Leet et al., SAE Technical Paper 980179, "EGR's Effect on Oil Degradation and Intake System Performance," Feb. 23–26, 1998, especially pages 57–59, and McKinley, SAE Technical Paper 970636, "Modeling Sulfuric Acid Condensation in Diesel Engine EGR Coolers," Feb. 24–27, 1997, especially page 207; and references cited in each.

Diesel engines typically consume hydrocarbon fuels, normally referred to as diesel fuels. Recently, water-blend fuels (hydrocarbons blended with up to e.g. 20% water, with appropriate emulsifiers and other additives) have been used. The method of the present invention is useful for engines consuming any of these fuels, including low sulfur diesel fuels and diesel fuels obtained from a Fischer-Tropsch process. Low sulfur diesel fuels can contain 15 or less parts per million sulfur.

The present invention relates to sump-lubricated engines, that is, those in which the lubricant is retained in a sump or reservoir from which it is circulated to and through the engine. This is in contrast to systems, characteristic of certain two-stroke cycle engines, in which the lubricant is mixed with the fuel and the fuel-lubricant mixture passes through the engine only once before being consumed.

The engines in which the present invention can be used are typically compression-ignited (diesel) engines. It is especially useful in heavy duty diesel engines, although benefits are also observed in other engines including small diesel engines. The distinction between heavy duty and small diesel engines is principally one of piston displacement within the engine cylinders. Small diesel engines, typically used in passenger cars, particularly in Europe, normally have a displacement of less than 3L, typically up to 2.5L, and commonly below 2L. In contrast, heavy duty diesel engines are typically used in trucks and off-road vehicles and will normally have a displacement of 3L or greater, typically 6 to 12 L or even greater, particularly for certain off-road vehicles.

The first component of the lubricant is an oil of lubricating viscosity, including natural or synthetic or semisynthetic lubricating oils and mixtures thereof. Natural oils include animal oils, vegetable oils, mineral lubricating oils of paraffinic, naphthenic, or mixed types, solvent or acid treated mineral oils, and oils derived from coal or shale. Synthetic lubricating oils include hydrocarbon oils, halo-substituted hydrocarbon oils, alkylene oxide polymers (including those made by polymerization of ethylene oxide or propylene oxide), esters of dicarboxylic acids and a variety of alcohols including polyols, esters of monocarboxylic acids and polyols, esters of phosphorus-containing acids, polymeric tetrahydrofurans, and silicon-based oils (including siloxane oils and silicate oils). Included are unrefined, refined, and rerefined oils. Specific examples of the oils of lubricating viscosity are described in U.S. Pat. No. 4,326,972.

Lubricating oils have also been categorized as API Groups I, II, III, IV, and V, on the basis of parameters such as sulfur content, saturate content, and viscosity index. Group III oils are generally considered superior, in these categories to Group II, which is turn is superior to Group I. Group IV comprises all polyalphaolefins, and Group V comprises oils not included in the other groups. Group III base oils are also sometimes considered to be synthetic base oils, and for the purposes of this invention they can be considered to be included within the definition of "synthetic base oils." Group III base oils are defined by the API Base Oil Interchange Guidelines as having the following minimum characteristics: ≦0.03% sulfur, ≧90% saturates, and ≧120 viscosity index. These are generally oils which are derived from natural stocks (as opposed to being derived from synthetic sources), but are so highly refined that they can exhibit the performance and viscosity parameters of other synthetic base oils. The present invention can be used with any of these oils, although it is particularly useful with Groups II, III, and IV or with oils comprising groups III, IV, and V. It is also useful in base oils prepared by a Fischer-Tropsch process.

The lubricating oil will normally comprise the major amount of the composition used for the present invention. Thus it will normally be at least 50% by weight of the composition, preferably about 83 to about 98%, and most preferably about 88 to about 90%.

The lubricant composition will include at least one or more of the additives which are conventional for use in an engine oil lubricant, and in particular for a lubricant for diesel engines. A description of common lubricant additives can be found, for example, in Smalheer, Lubricant Additives, 1967 Lezius-Hiles Company, Cleveland. Among important additives are detergents, dispersants, corrosion inhibitors, antioxidants, pour point depressants, extreme pressure additives, and such miscellaneous additives as rust inhibitors and anti-foam agents. Numerous additives are also disclosed in European Patent Application 386 803A. Viscosity index improvers are also important and are often considered additives, although they are sometimes also considered as a part of the base oil, particularly when a multigrade oil is designated. In particular, the lubricant of the present invention will include at least one additive selected from the group consisting of dispersants, detergents, anti-wear agents. Preferably at least one of each of these components will be present.

Dispersants are well known in the field of lubricants and include primarily what are sometimes referred to as "ashless" dispersants because (prior to mixing in a lubricating composition) they do not contain ash-forming metals and they do not normally contribute any ash forming metals when added to a lubricant. Dispersants are characterized by a polar group attached to a relatively high molecular weight hydrocarbon chain.

One class of dispersant is Mannich bases. These are materials which are formed by the condensation of a higher molecular weight, alkyl substituted phenol, an alkylene polyamine, and an aldehyde such as formaldehyde. Such materials may have the general structure

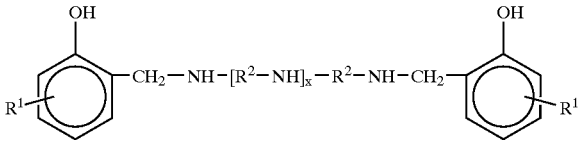

(including a variety of isomers and the like) and are described in more detail in U.S. Pat. No. 3,634,515.

Another class of dispersant is high molecular weight esters. These materials are similar to the above-described Mannich dispersants or the succinimides described below, except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Other dispersants include polymeric dispersant additives, which are generally hydrocarbon-based polymers which contain polar functionality to impart dispersancy characteristics to the polymer.

A preferred class of dispersants is the carboxylic dispersants. Carboxylic dispersants include succinic-based dispersants, which are the reaction product of a hydrocarbyl substituted succinic acylating agent with an organic hydroxy compound or, preferably, an amine containing at least one hydrogen attached to a nitrogen atom, or a mixture of said hydroxy compound and amine. The term "succinic acylating agent" refers to a hydrocarbon-substituted succinic acid or succinic acid-producing compound (which term also encompasses the acid itself). Such materials typically include hydrocarbyl-substituted succinic acids, anhydrides, esters (including half esters) and halides.

Succinic based dispersants have a wide variety of chemical structures including typically structures such as

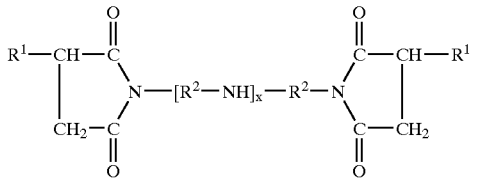

In the above structure, each $R^1$ is independently a hydrocarbyl group, preferably a polyolefin-derived group having an $\overline{M}$nof 500 or 700 to 10,000. Typically the hydrocarbyl group is an alkyl group, frequently a polyisobutyl group with a molecular weight of 500 or 700 to 5000, preferably 1500 or 2000 to 5000. Alternatively expressed, the $R^1$ groups can contain 40 to 500 carbon atoms and preferably at least 50, e.g., 50 to 300 carbon atoms, preferably aliphatic carbon atoms. The $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. Nos. 4,234,435 and 3,172,892.

The polyalkenes from which the substituent groups are derived are typically homopolymers and interpolymers of polymerizable olefin monomers of 2 to 16 carbon atoms; usually 2 to 6 carbon atoms.

The olefin monomers from which the polyalkenes are derived are polymerizable olefin monomers characterized by the presence of one or more ethylenically unsaturated groups (i.e., >C=C<); that is, they are mono-olefinic monomers such as ethylene, propylene, 1-butene, isobutene, and 1-octene or polyolefinic monomers (usually diolefinic monomers) such as 1,3-butadiene, and isoprene. These olefin monomers are usually polymerizable terminal olefins; that is, olefins characterized by the presence in their structure of the group $>C=CH_2$. Relatively small amounts of non-hydrocarbon substituents can be included in the polyolefin, provided that such substituents do not substantially interfere with formation of the substituted succinic acid acylating agents.

Each R1 group may contain one or more reactive groups, e.g., succinic groups, thus being represented (prior to reaction with the amine) by structures such as

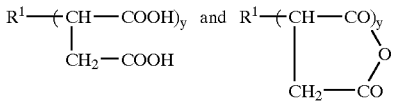

in which y represents the average number of such succinic groups attached to the $R^1$ group. In one type of dispersant, y=1. In another type of dispersant, y is greater than 1, preferably greater than 1.3 or greater than 1.4; and most preferably y is equal to or greater than 1.5. Preferably y is 1.4 to 3.5, especially is 1.5 to 3.5 and most especially 1.5 to 2.5. Fractional values of y, of course, can arise because different specific $R^1$ chains may be reacted with different numbers of succinic groups.

The amines which are reacted with the succinic acylating agents to form the carboxylic dispersant composition can be monoamines or polyamines. In either case they will be characterized by the formula $R_4R_5NH$ wherein $R_4$ and $R_5$ are each independently hydrogen, or hydrocarbon, amino-substituted hydrocarbon, hydroxy-substituted hydrocarbon, alkoxy-substituted hydrocarbon, amino, carbamyl, thiocarbamyl, guanyl, and acylimidoyl groups provided that only one of $R_4$ and $R_5$ is hydrogen. In all cases, therefore, they will be characterized by the presence within their structure of at least one H—N< group. Therefore, they have at least one primary (i.e., $H_2N$—) or secondary amino (i.e., H—N<) group. Examples of monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamine, and octadecylamine.

The polyamines from which (C) is derived include principally alkylene amines conforming, for the most part, to the formula

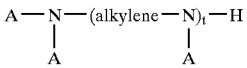

wherein t is an integer preferably less than 10, A is a hydrogen group or a hydrocarbyl group preferably having up to 30 carbon atoms, and the alkylene group is preferably an alkylene group having less than 8 carbon atoms. The alkylene amines include principally methylene amines, ethylene amines, hexylene amines, heptylene amines, octylene amines, other polymethylene amines. They are exemplified specifically by: ethylene diamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene) triamine. Higher homologues such as are obtained by condensing two or more of the above-illustrated alkylene amines likewise are useful. Tetraethylene pentamines is particularly useful.

The ethylene amines, also referred to as polyethylene polyamines, are especially useful. They are described in some detail under the heading "Ethylene Amines" in Encyclopedia of Chemical Technology, Kirk and Othmer, Vol. 5, pp. 898–905, Interscience Publishers, New York (1950).

Hydroxyalkyl-substituted alkylene amines, i.e., alkylene amines having one or more hydroxyalkyl substituents on the nitrogen atoms, likewise are useful. Examples of such amines include N-(2-hydroxyethyl)ethylene diamine, N,N'-bis(2-hydroxyethyl)-ethylene diamine, 1-(2-hydroxyethyl) piperazine, monohydroxypropyl)-piperazine, di-hydroxypropyl-substituted tetraethylene pentamine, N-(3-hydroxypropyl)-tetra-methylene diamine, and 2-heptadecyl-1-(2-hydroxyethyl)-imidazoline.

Higher homologues, such as are obtained by condensation of the above-illustrated alkylene amines or hydroxy alkyl-substituted alkylene amines through amino radicals or through hydroxy radicals, are likewise useful.

The carboxylic dispersant composition (C), obtained by reaction of the succinic acid-producing compounds and the amines described above, may be amine salts, amides, imides, imidazolines as well as mixtures thereof. To prepare the carboxylic dispersant composition (C), one or more of the succinic acid-producing compounds and one or more of the amines are heated, optionally in the presence of a normally liquid, substantially inert organic liquid solvent/diluent at an elevated temperature, generally in the range of 80° C. up to the decomposition point of the mixture or the product; typically 100° C. to 300° C.

The succinic acylating agent and the amine (or organic hydroxy compound, or mixture thereof) are typically reacted in amounts sufficient to provide at least one-half equivalent, per equivalent of acid-producing compound, of the amine (or hydroxy compound, as the case may be). Generally, the maximum amount of amine present will be about 2 moles of amine per equivalent of succinic acylating agent. For the purposes of this invention, an equivalent of the amine is that amount of the amine corresponding to the total weight of amine divided by the total number of nitrogen atoms present. The number of equivalents of succinic acid-producing compound will vary with the number of succinic groups present therein, and generally, there are two equivalents of acylating reagent for each succinic group in the acylating reagents. Additional details and examples of the procedures for preparing the nitrogen-containing compositions of the present invention by reaction of succinic acid-producing compounds and amines are included in, for example, U.S. Pat. Nos. 3,172,892; 3,219,666; 3,272,746; and 4,234,435.

The dispersants may be borated materials. Borated dispersants are well-known materials and can be prepared by treatment with a borating agent such as boric acid. Typical conditions include heating the dispersant with boric acid at 100 to 150° C. The dispersants may also be treated by reaction with maleic anhydride as described in PCT patent publication WO00/26327.

The amount of dispersant in the compositions used for the present invention can be 1 to 8 percent by weight, typically 3 to 5 percent by weight, and preferably 2 to 6 percent by weight.

Detergents are generally salts of organic acids, which are often overbased. Overbased salts of organic acids are typically metal salts, although non-metallic overbased salts are known. Overbased salts are widely known to those of skill in the art and generally include metal salts wherein the amount of metal present exceeds the stoichiometric amount. Such salts are said to have conversion levels in excess of 100% (i.e., they comprise more than 100% of the theoretical amount of metal needed to convert the acid to its "normal" or "neutral" salt). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The terminology "metal ratio" is used in the prior art and herein to designate the ratio of the total chemical equivalents of the metal in the overbased salt to the chemical equivalents of the metal in the salt which would be expected to result in the reaction between the organic acid to be overbased and the basic reacting metal compound according to the known chemical reactivity and stoichiometry of the two reactants. Thus, in a normal or neutral salt the metal ratio is one and, in an overbased salt, the metal ratio is greater than one. The overbased salts used as component (A) in this invention usually have metal ratios of at least 3:1. Typically, they have ratios of at least 12:1. Usually they have metal ratios not exceeding 40:1. Typically, salts having ratios of 12:1 to 20:1 are used.

Overbased compositions are well known. Overbased compositions can be prepared based on a variety of other well known organic acidic materials including sulfonic acids, carboxylic acids (including substituted salicylic acids), phenols, phosphonic acids, and mixtures of any two or more of these.

Preferred overbased materials include overbased phenates derived from the reaction of an alkylated phenol, preferably wherein the alkyl group has at least 6 aliphatic carbon atoms. The phenate is optionally reacted with formaldehyde or a sulfurization agent, or mixtures thereof, to provide a bridged or linked structure.

Other preferred overbased materials include metal overbased sulfonates derived from an alkylated aryl sulfonic acid wherein the alkyl group has at least about 15 aliphatic carbon atoms. Yet other preferred overbased materials include metal overbased carboxylates derived from fatty acids having at least about 8 aliphatic carbon atoms.

The basically reacting metal compounds used to make these overbased salts are usually an alkali or alkaline earth metal compound (i.e., the Group IA, IIA, and IIB metals excluding francium and radium and typically excluding rubidium, cesium and beryllium), although other basically reacting metal compounds can be used. Compounds of Ca, Ba, Mg, Na, K, and Li, such as their hydroxides and alkoxides of lower alkanols are usually used as basic metal compounds in preparing these overbased salts but others can be used as shown by the prior art referred to herein. Overbased salts containing a mixture of ions of two or more of these metals can be used in the present invention.

Overbased materials are generally prepared by reacting an acidic material (typically an inorganic acid or lower carboxylic acid, preferably carbon dioxide) with a mixture comprising an acidic organic compound, a reaction medium comprising at least one inert, organic solvent (such as mineral oil, naphtha, toluene, or xylene) for said acidic organic material, a stoichiometric excess of a base (typically a metal base), and a promoter. The acidic material used in preparing the overbased material can be a liquid such as formic acid, acetic acid, nitric acid, or sulfuric acid. Acetic acid is particularly useful. Inorganic acidic materials can also be used, such as HCl, $SO_2$, $SO_3$, $CO_2$, or $H_2S$, preferably $CO_2$ or mixtures thereof, e.g., mixtures of $CO_2$ and acetic acid.

A promoter is a chemical employed to facilitate the incorporation of metal into the basic metal compositions. The promoters are diverse and are well known in the art. A discussion of suitable promoters is found in U.S. Pat. Nos. 2,777,874, 2,695,910, and 2,616,904. These include the alcoholic and phenolic promoters, which are preferred. The alcoholic promoters include the alkanols of one to twelve carbon atoms such as methanol, ethanol, amyl alcohol, octanol, isopropanol, and mixtures of these. Phenolic promoters include a variety of hydroxy-substituted benzenes and naphthalenes. a particularly useful class of phenols are the alkylated phenols of the type listed in U.S. Pat. No. 2,777,874, e.g., heptylphenols, octylphenols, and nonylphenols. Mixtures of various promoters are sometimes used.

Patents specifically describing techniques for making basic salts of acidic organic compounds generally include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

One useful detergent compound is a metal saligenin derivative. Such materials have been described in detail in U.S. Pat. No. 6,310,009. These materials can be useful if a low-sulfur or sulfur-free detergent is desired. Other low-sulfur or sulfur free detergents include those formed from carboxylic acids, substituted phenols, and substituted salicylates. Also in this category are overbased calixarates, which are described, for example, in U.S. Pat. No. 6,174,844.

The amount of detergent in the compositions useful in the present invention can be 0.2 to 6 percent, typically 0.5 to 5 percent, preferably 1 to 3 percent by weight. The amount of detergent may also be 0%, or 0% metal-containing detergent, if an ashless formulation is desired.

Anti-wear additives include sulfur-, phosphorus-, or sulfur- and phosphorus-containing antiwear agents and boron-containing anti-wear agents. The term antiwear agent refers to compounds which provide wear protection properties to lubricating compositions and functional fluids. The antiwear agent is useful in controlling wear and may also act as an extreme pressure agent. These antiwear agents include sulfurized organic compounds, hydrocarbyl phosphates, phosphorus-containing amides, phosphorus-containing carboxylic esters, phosphorus-containing ethers, and dithiocarbamate-containing compounds.

In one embodiment, the antiwear agent is a sulfurized organic composition, preferably a sulfurized olefin such as a mono-, or disulfide or mixtures thereof. These materials generally have sulfide linkages having from 1 to 10 sulfur atoms, preferably 1 to 4, more preferably 1 or 2. Materials which can be sulfurized to form the sulfurized organic compositions of the present invention include oils, fatty acids or esters, olefins or polyolefins made thereof, terpenes, or Diels-Alder adducts. Details of methods of preparing some such sulfurized materials can be found in U.S. Pat. Nos. 3,471,404 and 4,191,659.

In one embodiment, the antiwear agent is a hydrocarbyl phosphate, such as a mono-, di- or trihydrocarbyl phosphate. Hydrocarbyl phosphates can be prepared by reacting a phosphorus acid or anhydride, preferably phosphorus pentoxide with an alcohol at a temperature of 30° C. to 200° C., preferably 80° C. to 150° C. The phosphorus acid is generally reacted with the alcohol in a ratio of 1:3.5, preferably about 1:3.

The hydrocarbyl phosphate can also be a hydrocarbyl thiophosphate. Thiophosphates may contain from one to three sulfur atoms, preferably one or two sulfur atoms. Thiophosphates are prepared by reacting one or more of the above-described phosphites with a sulfurizing agent including sulfur, sulfur halides, and sulfur containing compounds, such as sulfurized olefins, sulfurized fats, and mercaptans.

Metal salts of the formula

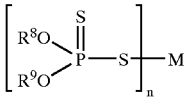

wherein $R^8$ and $R^9$ are independently hydrocarbyl groups containing 3 to 30 carbon atoms are readily obtainable by the reaction of phosphorus pentasulfide ($P_2S_5$) and an alcohol or phenol to form an O,O-dihydrocarbyl phosphorodithioic acid corresponding to the formula

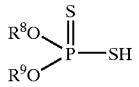

The reaction involves mixing at a temperature of 20° C. to 120 or 180° C., four moles of an alcohol or a phenol with one mole of phosphorus pentasulfide. Hydrogen sulfide is liberated in this reaction. The acid is then reacted with a basic metal compound to form the salt. The metal M, having a valence n, generally is aluminum, lead, tin, manganese, cobalt, nickel, zinc, or copper, and most preferably zinc. The basic metal compound is thus preferably zinc oxide, and the resulting metal compound is represented by the formula

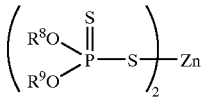

The $R^8$ and $R^9$ groups are independently hydrocarbyl groups that are preferably free from acetylenic and usually also from ethylenic unsaturation. They are typically alkyl, cycloalkyl, aralkyl or alkaryl group and have 3 to 20 carbon atoms, preferably 3 to 16 carbon atoms and most preferably up to 13 carbon atoms, e.g., 3 to 12 carbon atoms. The alcohols which react to provide the $R^8$ and $R^9$ groups can be one or more primary alcohols, one or more secondary alcohols, a mixture of secondary alcohol and primary alcohol. A mixture of two secondary alcohols such as isopropanol and 4-methyl-2-pentanol is often desirable.

Such materials are often referred to as zinc dialkyldithiophosphates or simply zinc dithiophosphates. They are well known and readily available to those skilled in the art of lubricant formulation.

In another embodiment, the antiwear agent can be a phosphorus-containing amide. Phosphorus-containing amides are generally prepared by reacting a phosphorus acids such as a phosphoric, phosphonic, phosphinic, or thiophosphoric acid with an unsaturated amide, such as an acrylamide. Preferably the phosphorus acid is a dithiophosphorus acid prepared by reacting a phosphorus sulfide with an alcohol or phenol to form dihydrocarbyl dithiophosphoric acid. Phosphorus-containing amides are known in the art and are disclosed in U.S. Pat. Nos. 4,876,374, 4,770,807 and 4,670,169.

Alternatively, the antiwear agent can be a dithiocarbamate-containing compound such as dithiocarbamate esters, dithiocarbamate amides, dithiocarbamic ethers, or alkylene-coupled dithiocarbamates. The dithiocarbamate amides, ether, and esters are prepared in a manner similar as that described above for phosphorus-containing amides and esters. Generally, the dithiocarbamic acid is reacted with an unsaturated amide, ether, or ester to form the dithiocarbamate-containing compounds. The dithiocarbamates used in making the dithiocarbamate-containing compound are prepared by reacting an amine with carbon disulfide or carbonyl sulfide. The dithiocarbamates are reacted with an unsaturated compound at 25° C. to 125° C., preferably 70° C. to 90° C. in the presence or absence of solvent. Lubricants containing alkylene dithiocarbamic compounds are described, for example, in U.S. Pat. No. 3,876,550.

Another type of anti-wear agent which can be used is a borate ester. The borate esters are well known to those skilled in the art and can be prepared by reacting of one or more of boron compounds with one or more alcohols. Typically, the alcohols contain from 6 to 30, or from 8 to 24 carbon atoms. The methods of making such borate esters are known to those in the art. Various types of borate esters and their methods of preparation are disclosed in greater detail in U.S. Pat. No. 5,883,057.

The amount of the antiwear agent can be typically 0.01 to 10 percent by weight of the composition, more commonly 0.1 to 2 percent. If the antiwear agent is a phosphorus-containing agent, it is frequently convenient to express its amount as the percent phosphorus contributed thereby to the composition. On that basis, the antiwear agent typically contributes 0.025 to 0.17 percent by weight phosphorus, preferably 0.05 to 0.143 percent, and more preferably 0.05 to 0.08 percent to the composition.

The total amount of the dispersant, detergent, and antiwear additive components in the present lubricants will typically be 3 to 15 percent by weight, preferably 4 to 10 percent, more preferably 5 to 9 percent.

The lubricating oil compositions of the present invention also may contain, particularly when the lubricating oil compositions are formulated into multi-grade oils, one or more viscosity modifiers. Viscosity modifiers generally are polymeric materials, typically hydrocarbon-based polymers generally having number average molecular weights between 25,000 and 500,000, more often between 50,000 and 200,000. Examples of suitable hydrocarbon polymers include homopolymers and copolymers of two or more monomers of C2 to C30, e.g., $C_2$ to $C_8$ olefins, including both alphaolefins and internal olefins, which may be straight or branched, aliphatic, aromatic, alkyl-aromatic, or cycloaliphatic. Frequently they will be copolymers of ethylene with $C_3$ to $C_{30}$ olefins, particularly preferred being the copolymers of ethylene and propylene. Other polymers can be used such as polyisobutylene, homopolymers and copolymers of $C_6$ and higher alphaolefins, atactic polypropylene hydrogenated polymers and copolymers and terpolymers of styrene, e.g., with isoprene and/or butadiene.

Hydrogenated styrene-conjugated diene copolymers are another class of commercially available viscosity modifiers for motor oils. These polymers include polymers which may be described as hydrogenated or partially hydrogenated homopolymers, and random, tapered, star, or block interpolymers (including terpolymers and tetrapolymers). Examples of styrenes include styrene, alpha-methyl styrene, ortho-methyl styrene, meta-methyl styrene, para-methyl styrene, and para-tertiary butyl styrene. Preferably the conjugated diene contains four to six carbon atoms. Examples of conjugated dienes include piperylene, 2,3-dimethyl-1,3-butadiene, chloroprene, isoprene, and 1,3-butadiene, with isoprene and butadiene being particularly preferred. Mixtures of such conjugated dienes can also be used.

These copolymers are typically hydrogenated in solution so as to remove a substantial portion of their olefinic double bonds. It is preferred that these copolymers, for reasons of oxidative stability, contain no more than 5% and preferably no more than 0.5% residual olefinic unsaturation on the basis of the total number of carbon-to-carbon covalent linkages within the average molecule. These copolymers typically have number average molecular weights in the range of 30,000 to 500,000, preferably 50,000 to 200,000. Such hydrogenated copolymers have been described in U.S. Pat. Nos. 3,551,336; 3,598,738; 3,554,911; 3,607,749; 3,687,849; and 4,181,618.

Esters obtained by copolymerizing styrene and maleic anhydride in the presence of a free radical initiator and thereafter esterifying the copolymer with a mixture of C4–18 alcohols also are useful as viscosity modifying additives. The styrene esters generally are considered to be multi-functional premium viscosity modifiers. The styrene esters in addition to their viscosity-modifying properties also are pour point depressants and exhibit dispersancy properties when the esterification is terminated before its completion leaving some unreacted anhydride or carboxylic acid groups. These acid groups can then be converted to imides by reaction with a primary amine.

Polymethacrylates (PMA) are also used as viscosity modifiers. These materials are prepared from mixtures of methacrylate monomers having different alkyl groups. The alkyl groups may be either straight chain or branched chain groups containing from 1 to 18 carbon atoms. Most PMA's are viscosity modifiers as well as pour point depressants.

When a small amount of a nitrogen-containing monomer is copolymerized with alkyl methacrylates, dispersancy properties are also incorporated into the product, and the resulting materials are often referred to as dispersant viscosity modifiers. Thus, such a product has the multiple function of viscosity modification, pour point depressancy and dispersancy. Such products have been referred to in the art as dispersant-type viscosity modifiers or simply dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers.

The amount of the viscosity index modifier will typically be 0.5 to 7 percent by weight, or 0.5 to 2 percent, or 2 to 5 percent. In a synthetic base oil, the amount of viscosity modifier can often be reduced. The viscosity modifiers can be employed in varying amounts in various viscosity base oils in a known manner, to prepare multigrade oils of a variety of viscosities, including such grades as 0W-30, 5W-30, 10W-30, 10W-40, 15W-40, and others. Unmodified monogrades such as 20W, 30W, 40W, or 50W can also be used.

The formulation as thus far described can be considered to be a typical lubricant formulation for use in lubricating engines, in particular, diesel engines. Specific formulations of this type are disclosed for instance in U.S. Pat. Nos. 4,981,602, 5,328,620 and 5,595,964.

In addition to the components normally found in an engine lubricant, the lubricants suitable for use in the present invention also include a minor amount of an amide of an aliphatic carboxylic acid, said acid containing 6 to 28 carbon atoms. The amide can be based on such an acid and either an amine (secondary or, preferably, primary) or ammonia, although amides based on ammonia, that is, N-unsubstituted amides, are preferred.

The aliphatic carboxylic acids which form the amide can preferably contain 8 to 24, carbon atoms, or 12 to 20 carbon atoms, and preferably 14, 16, or 18 carbon atoms, or mixtures thereof. Acids with 18 carbon atoms, such as stearic acid and oleic acid, are useful. The resulting amides, if prepared with ammonia, are stearamide and oleamide. Commercial mixtures of amides, such as Armid O™ from Akzo Nobel Chemicals can be used.

The amount of the amide in the lubricant is typically 0.05 to 1 percent by weight, preferably 0.1 to 0.6 percent by weight, and more preferably 0.1 or 0.2 to 0.4 percent by weight.

The compositions used in the present invention, may, if desired, be made compatible with diesel engine after treatment devices such as particulate filters or oxidation catalysts. Since such devices may require a low level of phosphorus and/or a low level of sulfated ash, the formulations of the present invention can be prepared using low phosphorus or phosphorus-free components and low ash or ashless components.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

- hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);
- substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);
- hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

EXAMPLES

Example 1

A conventional lubricant formulation is prepared based on a partially synthetic multigrade base fluid (5W-30). The formulation contains 100 parts by weight of a mixture of base oils, including mineral oil (18.6 parts) and polyalphaolefin (81.4 parts) with viscosity modifiers (listed below) to provide a 5W-30 formulation. The additional components in the lubricant formulation (by weight) are: 0.92 parts viscosity modifiers (ethylene copolymer and aromatic/ester copolymer), 3.6 parts succinimide dispersant, 1.05 parts zinc dialkyldithiophosphate, 1.56 parts overbased calcium alkylsulfonate detergents, 0.99 parts sulfurized overbased calcium alkylphenate detergents; smaller amounts of other conventional additives (inhibitors and antifoam agent), accompanied by 12.0 parts diluent oil. One portion of the lubricant was top-treated by adding 0.3 parts by weight oleamide; a baseline portion was not so treated. Each portion is tested, in turn, in lubricating two diesel powered vehicles, the first a Volvo™ truck powered by a D12 engine and the second a Mercedes Benz™ truck powered by an OM 501LA engine. In neither case is the engine fitted with an exhaust gas recycle system, but it is believed that the trends observed are qualitatively similar to those that will be observed in an engine with exhaust gas recycle. Each vehicle is tested in three driving cycles: Urban, Suburban, and Motorway. The Urban cycle lasts 600 seconds and includes stop-and-go driving at speeds of up to 50 km/h. The Suburban cycle lasts 600 second and includes speeds up to 80 km/h (typically about 70 km/h average). The Motorway cycle lasts 600 seconds and includes speeds up to 90 km/h. The oil sump temperatures for each test (average of 3 measurements) are reported in Table I:

TABLE I

| | Temperature, ° C. | |
|---|---|---|
| Test | Oil Sump | Oil Gallery |
| Vehicle 1, Urban, baseline | 90.51 | 95.57 |
| with amide | 84.29 | 91.51 |
| Suburban, baseline | 87.82 | 96.88 |
| with amide | 81.82 | 95.74 |
| Motorway, baseline | 89.03 | 99.60 |
| with amide | 81.62 | 98.38 |
| Vehicle 2, Urban, baseline | 85.11 | 74.02 |
| with amide | 84.37 | 73.26 |
| Suburban, baseline | 85.25 | 76.26 |
| with amide | 85.07 | 75.61 |
| Motorway, baseline | 88.63 | 77.73 |
| with amide | 88.59 | 77.21 |

The results show that the temperature of the oil in the sump is reduced by up to 8.4° C. due to the presence of the small amount of amine. Temperature measurements at the oil gallery (within the piston itself) show smaller but significant reductions in temperature of 0.5 to 4.1° C.

Example 2

A similar test is conducted in a small stationary 0.2 L 1-cylinder Yanmar engine with forced air cooling (without exhaust gas recycling). The temperature of the oil in the sump and the cylinder wall are measured and the average results presented in this 5-stage, 2 hour test. Stage 1 is the start-up stage after the engine oil is flushed into the engine. During Stage 2, no external heating is applied and the engine warms naturally. During Stages 3 and 4, a standard amount of external heating is applied to force the engine to progressively higher temperatures. During Stage 5, more intense external heating is applied to attempt to force the cylinder wall temperature to 135° C. The lubricants tested are the same formulations reported for Example 1. The results of testing, in ° C., are shown in Table II.

TABLE II

| | Baseline | | With amide, | | |
|---|---|---|---|---|---|
| Stage | Temp. | Increase | Temp. | Increase | Difference |
| 1 | 86.64 | 0 | 86.70 | 0 | — |
| 2 | 93.99 | 7.35 | 92.75 | 6.05 | 1.30 |
| 3 | 98.95 | 12.31 | 98.00 | 11.30 | 1.01 |

TABLE II-continued

| | Baseline | | With amide, | | |
|---|---|---|---|---|---|
| Stage | Temp. | Increase | Temp. | Increase | Difference |
| 4 | 104.73 | 18.09 | 103.31 | 16.61 | 1.48 |
| 5 | 113.94 | 27.30 | 112.90 | 26.20 | 1.10 |

The results show a reduction in temperature of up to about 1.5° C.

Example 3

A pair of lubricants are tested in a Mack™ E-7 engine under the conditions of the Mack™ T8 test. The engine is lubricated with a baseline formulation; the lubricant in the second trial further contains 0.25 weight percent oleamide, to provide the test fluid of the present invention. The baseline lubricant comprises a viscosity modified 15W-40 base oil formulation to which is added 3.6 percent by weight succinimide dispersant(s), 1.05 percent zinc dialkyldithiophosphate(s), 2.84 percent overbased Ca sulfonate, phenate, and salicylate detergent(s), 1.0 percent antioxidants, and smaller amounts of other conventional additives, accompanied by 6.6 percent diluent oil. Temperature is measured in the oil sump and at the oil cooler inlet and oil cooler outlet under conditions of Idle, Peak Torque, and Peak Power. A sample of the base-line oil was run before and after the test oil, and the average results reported. The results in ° C. are shown in Table III.

TABLE III

| | | Oil cooler inlet | Oil cooler outlet | Oil sump |
|---|---|---|---|---|
| Stage 2: Peak Torque | Baseline | 106.1 | 96.4 | 105.6 |
| | Test fluid | 104.4 | 95.0 | 103.9 |
| Stage 3: Peak Power | Baseline | 108.6 | 98.7 | 107.9 |
| | Test fluid | 106.9 | 97.3 | 106.2 |

The results show a reduction of temperature of up to 1.7° C. (Measurements of oil temperatures under idle conditions (Stage 1) did not show a significant difference.)

Example 4

A lubricant of the present invention is tested in a Cummins™ M11 diesel engine which is equipped with exhaust gas recycle, using the same fluids as in Example 1. There are three 12-hour stages in the test, with 2-hour lubricant flushes between stages. The first and third stages are run with a the reference lubricant formulation. The second stage is run using a lubricant of the present invention.

Each test stage comprises three 4-hour phases, in which the engine is run under conditions characteristic of idle, torque, and power operation. The lubricant sump temperature and the cylinder liner temperatures are measured in each phase. Temperatures for the initial and final stages, each involving the reference lubricant, are presented as an average value. Two separate tests are run. The results are reported in the following table:

TABLE IV

| Stage, Location/ Temp. ° C. | Reference Lubricant | Test Lubricant |
|---|---|---|
| Idle, Liner, Test 1 | 67.00 | 66.81 |
| Idle, Liner, Test 2 | 66.10 | 66.05 |
| Liner, Torque, Test 1 | 92.58 | 91.61 |
| Liner, Torque, Test 2 | 90.49 | 89.16 |
| Liner, Power, Test 1 | 96.61 | 96.62 |
| Liner, Power, Test 2 | 93.37 | 93.14 |
| Idle, Sump, Test 1 | 72.35 | 70.77 |
| Idle, Sump, Test 2 | 72.66 | 72.60 |
| Torque, Sump, Test 1 | 124.24 | 118.57 |
| Torque, Sump, Test 2 | 124.15 | 124.03 |
| Power, Sump, Test 1 | 125.23 | 124.65 |
| Power, Sump, Test 2 | 125.07 | 124.86 |

The results show that a significant and unexpected decrease in temperature is observed at the liner location, averaging a decrease of about 0.5° C. overall, and, for the Torque phase, a decrease of about 1.1° C. The decrease in temperature in the engine sump is even more pronounced, averaging nearly 1.4° C.

Example 5

A field test is run using two trucks equipped with 2000 model year Mack E7 engines, without exhaust gas recycle. Each engine is lubricated with a baseline formulation; the lubricant of one engine further contains 0.25 weight percent oleamide, to provide the lubricant of the present invention. The baseline lubricant comprises a viscosity modified 15W-40 base oil formulation to which is added 3.6 percent by weight succinimide dispersant(s), 1.05 percent zinc dialkyldithiophosphate(s), 2.84 percent overbased Ca sulfonate, phenate, and salicylate detergent(s), 1.0 percent antioxidants, and smaller amounts of other conventional additives, accompanied by 6.6 percent diluent oil.

The test is conducted substantially according to the Recommended Practice 1109 Type IV Fuel Economy Test Procedure of The Maintenance Council of the American Trucking Association, over a 222 km (138 mile) course over mostly level terrain with a 36,300 kg (80,000 lb.) gross vehicle weight load. The temperatures of the oil sump of the vehicles are measured over multiple runs, a minimum of three with the baseline formulation and a minimum of three with the modified formulation of the present invention. A statistical analysis is conducted, focusing on sump temperature during three portions of the test course at which oil temperatures are relatively elevated, due to greater engine load. The data are normalized prior to analysis to correct for a constant temperature differential (1.77° C.) between the two trucks. Temperature results are reported in the following table:

TABLE V

| | | Oil Sump Temperature, ° C. | | Temperature |
|---|---|---|---|---|
| Test Day | Test Portion | Baseline | Invention | reduction |
| 1 | 1 | 107.78 | 105.14 | 2.6 |
| 1 | 2 | 107.45 | 104.93 | 2.5 |
| 1 | 3 | 105.73 | 103.84 | 1.9 |
| 2 | 1 | 112.06 | 109.16 | 2.9 |
| 2 | 2 | 112.17 | 109.95 | 2.2 |
| 2 | 3 | 111.56 | 109.94 | 1.6 |

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A method for lubricating a sump-lubricated internal combustion heavy duty diesel engine equipped with an exhaust gas recirculation system, comprising supplying to said engine a lubricating oil composition comprising:

(a) an oil of lubricating viscosity;

(b) about 0.05 to about 1 percent by weight of an amide of an aliphatic carboxylic acid, said acid containing about 6 to about 28 carbon atoms; and (c) at least one additional additive selected from the group consisting of dispersants, detergents, and anti-wear agents;

whereby the oil-sump temperature or the piston-liner temperature is reduced under operating conditions, compared to that of a comparable composition without component (b).

2. The method of claim 1 wherein the oil of lubricating viscosity is a synthetic or semisynthetic fluid.

3. The method of claim 1 wherein the oil of lubricating viscosity comprises an API Group III, IV, or V oil.

4. The method of claim 1 wherein the oil of lubricating viscosity comprises an oil prepared by a Fischer-Tropsch process.

5. The method of claim 1 wherein the oil of lubricating viscosity is a multigrade formulation containing a viscosity modifier.

6. The method of claim 5 wherein the oil of lubricating viscosity is a 20W, 30W, 40W, 50W, 0W-30, 5W-30, 10W-30, 10W-40, or 15W-40, formulation.

7. The method of claim 1 wherein the amide is based on an aliphatic carboxylic acid containing 12 to 20 carbon atoms.

8. The method of claim 1 wherein the amide is oleamide.

9. The method of claim 1 wherein the amount of the amide is about 0.1 to about 0.4 percent by weight of the composition.

10. The method of claim 1 wherein the engine is a heavy duty diesel engine and the formulation contains a conventional heavy duty diesel engine lubricant additive package.

11. The method of claim 1 wherein the compositions comprises at least one dispersant, at least one detergent, and at least one anti-wear agent.

12. The method of claim 1 wherein the engine is a passenger car diesel engine.

13. The method of claim 1 wherein the combined amount of the components (c) is about 3 to about 15 weight percent.

14. The method of claim 1 wherein the engine consumes a low-sulfur diesel fuel.

15. The method of claim 1 wherein the engine consumes a fuel prepared by a Fischer-Tropsch process.

16. The method of claim 1 wherein some or all of the components (a) through (c) have interacted in situ.

* * * * *